US005979786A

United States Patent [19]

Longman et al.

[11] Patent Number: 5,979,786

[45] Date of Patent: Nov. 9, 1999

[54] FUEL INJECTION APPARATUS

[75] Inventors: David John Longman, City Beach; Lech Janusz Turno, Darlington, both of Australia

[73] Assignee: Orbital Engine Company (Australia) PTY Limited, Balcatta, Australia

[21] Appl. No.: 08/952,070

[22] PCT Filed: Jul. 1, 1996

[86] PCT No.: PCT/AU96/00402

§ 371 Date: Nov. 17, 1997

§ 102(e) Date: Nov. 17, 1997

[87] PCT Pub. No.: WO97/02425

PCT Pub. Date: Jan. 23, 1997

[30] Foreign Application Priority Data

Jun. 30, 1995 [AU] Australia ..... PN3912

[51] Int. Cl.[6] ..... B05B 1/30

[52] U.S. Cl. ..... 239/5; 239/585.5; 239/574

[58] Field of Search ..... 239/565.1–585.5, 239/408, 416.5, 413, 574; 251/629.21

[56] References Cited

U.S. PATENT DOCUMENTS

| | | | |
|---|---|---|---|
| 4,427,959 | 1/1984 | Chuzawa | 335/239 |
| 4,655,255 | 4/1987 | Rode | 137/627.5 |
| 5,004,162 | 4/1991 | Stettner et al. | 239/585 |
| 5,104,046 | 4/1992 | Sakagami | 239/585.1 |
| 5,381,966 | 1/1995 | Gernert | 239/585.1 X |
| 5,730,369 | 3/1998 | De Nagel et al. | 239/585.4 |

FOREIGN PATENT DOCUMENTS

| | | | |
|---|---|---|---|
| 0 251 519 | 1/1988 | European Pat. Off. . | |
| 427266 | 5/1991 | European Pat. Off. | 239/585.1 |
| 44 03 148A1 | 8/1995 | Germany . | |
| 1236140 | 6/1986 | U.S.S.R. | 239/585.1 |

*Primary Examiner*—Kevin Weldon
*Attorney, Agent, or Firm*—Nikaido, Marmelstein, Murray & Oram, LLP

[57] ABSTRACT

A single solenoid coil controls the movement of a first and second armature respectively. Each armature is connected to a valve element for controlling a fuel supply and for controlling the delivery of the charge respectively. During the period of energization of the solenoid coil, both the first and second armatures are actuated, with the above noted valve elements being caused to open and closed in a predetermined sequence.

14 Claims, 3 Drawing Sheets

FUEL INJECTION APPARATUS

This invention relates to solenoid operated actuators and, in particular, to solenoid operated fuel injection apparatus.

Fuel injection apparatus to inject fuel to a combustion chamber of an engine are well known. Equally well known are solenoid actuated fuel injection apparatus.

For example, the applicant's U.S. Pat. No. 4,934,329 discloses a fuel injection apparatus comprising a body with a port in the body providing communication with a combustion chamber of an engine in accordance with the operation of a valve element connected to a stem extending through a port cavity in the body. Electromagnetic means within the body are disposed about and operably connected to the valve stem. Accordingly, when the electromagnetic means is selectively energised and de-energised, the valve element may be moved to open and close the port. In that case, the electromagnetic means operates only the valve element which opens and closes the port. Delivery of fuel to the port cavity occurs in accordance with the control of a fuel metering unit, for example, the unit marketed by the Rochester Products Division of General Motors Corporation under the Trade Mark "Multec". Typically, the fuel metering unit would ordinarily include a separate solenoid actuated fuel metering valve.

U.S. Pat. No. 4,925,112, assigned to General Motors Corporation, discloses an injector adapted to deliver a charge of fuel and air directly into the combustion chamber of a two-stroke cycle engine. A pair of solenoid coils are aligned along a common axis situated between an armature that serves as a fuel metering valve and an armature that operates a charge delivery valve. The injector provides air and fuel injectors integrated into a single package in an effort to minimise the overall size of the injector.

The injectors described above are illustrations of units that, in certain applications, may present difficulties in respect to both size and cost. In the applicant's U.S. Pat. No. 4,934,329, the issue of the overall size of the injector unit is illustrated. That is, there is disclosed, in combination, a fuel metering unit and an individual fuel injection apparatus. Such a combination may, in certain applications, suffer the disadvantage of bulkiness. In addition, the number of moving parts and the requirement for separate fuel metering and fuel injection units invariably implies a greater cost than may be the case with a unit in which the metering and injection units are integrated. It will also be understood that a multiplicity of solenoid actuated valves is itself a cost factor.

U.S. Pat. No. 4,925,112, whilst disclosing the packaging of both a metering unit and an injection unit into the one apparatus, also illustrates the disadvantage of cost. In this patent, whilst there is disclosed one overall injector unit, there are still two solenoid coils actuating two valve armatures. The use of two individual coils creates the disadvantage that the overall unit remains heavy and somewhat bulky. Further, a cost disadvantage may be encountered in respect of the cost of two control channels and associated driver circuitry which are required for operation of the solenoid coils.

The above mentioned problems of size and cost are problems which become more difficult to ignore in price sensitive markets. Here, a cost difference of a small amount, in terms of a developed economy, may be significant enough to render a product unmarketable whether or not the product is technically advantageous.

Single solenoid fuel injectors have been proposed previously. See, for example, U.S. Pat. No. 5,004,162 and European Patent No. 404357. However, these systems have shown deficiencies when compared to systems wherein separate solenoids are provided for fuel and air charge delivery. The use of a single solenoid in these systems has introduced limitations in their operation. As the fuel and air charge valve armatures are no longer independent, difficulties have arisen where an overlap between fuel injection and air charge delivery is required, or where it is desired to commence fuel injection prior to commencing air charge delivery.

It is a first object of the present invention to provide a solenoid actuated apparatus that addresses some of the disadvantages of size and cost identified above.

It is a second object of the present invention to provide a fuel injection apparatus that addresses the some of the disadvantages of size and cost identified above.

With the first object in view, the present invention provides a solenoid operated actuator including a single solenoid coil, a first armature movable in response to selective energising and de-energising of the solenoid coil, a second armature movable in response to selective energising and de-energising of the same solenoid coil, said first armature and second armature being respectively arranged to move sequentially as the single solenoid is de-energised.

More specifically there is provided a solenoid operated actuator including a single solenoid coil and first and second armatures movable in response to selective energising and de-energising of the solenoid, said first and second armatures being respectively adapted to move sequentially in the same order between respective first and second positions as the single solenoid coil is energised and de-energised.

Preferably, the first and second armatures may be connected to respective first and second valves or switch elements and the armatures, whether actuating valves or switches or other means, may be designed to be operated in any desired time relationship in respect to one another. Conveniently, the first armature may be operable to open and close the first valve when the solenoid coil is selectively energised and de-energised and the second armature may be operable to open and close the second valve when the same solenoid coil is selectively energised and de-energised. An electronic control unit may be employed to control the operation of the actuator through control of energisation of the solenoid coil and may accordingly allow for separate or simultaneous operation of the respective armatures, features that may be desired in fuel injection applications as will be discussed hereinbelow. However, other modes of operation are also achievable.

The geometry of the armatures can be individually chosen to achieve or contribute to the attaining of the desired respective operation of the actuators. Additionally, the valve elements may be appropriately individually biased by springs or like devices into any desired extent and/or position. Typically, the valve or switch elements may be biased into a position corresponding with a closed position of the valve or switch. The magnetic force generated by the energisation of the solenoid coil to cause movement of the armature(s) is then required to overcome the biasing force. In this sense, the extent of the biasing force acting on an armature itself can be calculated and imposed by an appropriately selected spring or like means, providing an additional design parameter to influence the control of the movement of the armature.

Similarly, the armatures may be positioned relative to each other or in relation to the solenoid coil to achieve the desired performance. The operating parameters may be chosen for each application by way of calculation, trial and error or a combination of both.

Generally, a section of the armature, together with a solenoid housing or casing, forms a magnetic circuit around the solenoid coil. The magnetic circuit provides the energy to actuate the armature, as that part of the armature which is in the magnetic circuit is acted on by the magnetic flux in the circuit. Primary and secondary magnetic circuits are formed by the first and second armatures respectively in combination with the housing. It is desired to control the magnetic reluctance or resistance to magnetic flux in the respective magnetic circuits corresponding to first and second armatures, to thereby control the magnetic force applied to the armatures.

Reluctance in the magnetic circuit can be controlled in a number of ways.

The gap between the armature and the pole face or working surface of the housing, known as the magnetic gap, is one parameter on which reluctance is dependent. As the size of the magnetic gap increases, the reluctance of the magnetic circuit increases. It may be appreciated that each armature has at least two end positions, possibly corresponding with an open or closed position of a valve or switch. The magnetic gap of each armature is generally at its largest at one end position and at its smallest at the other end position. It is usual that in the at rest position the gap is at its largest and that when the armature is fully actuated by operation of the solenoid, the gap is at its smallest. As such, there may be a substantial difference between the reluctance of a particular magnetic circuit in the at rest and fully actuated positions thereof.

End stops may be used to restrict the end positions and thus control the magnetic gaps associated with the respective armatures. Where appropriate, low magnetic permeability spacers may be inserted between the armature and the pole face to ensure that a minimum gap is maintained.

The geometry of the armature itself affects the reluctance of the magnetic circuit. For example, reducing the cross-sectional area of the section of the armature forming part of the magnetic circuit increases the reluctance of the circuit.

Selection of the material of which the armature is formed can also provide a differential between the reluctance of the respective magnetic circuits.

The magnetic force applied to the armature acts against any biasing means holding the armature in its at rest position. Biasing means may be a spring or any other appropriate device.

It can be seen that by selecting appropriate magnetic gaps, armature geometry, armature material and biasing means for the first and second armatures, the solenoid energisation level required to actuate and hold the respective armatures at desired positions can be predetermined in order that the armatures are actuated in the sequence required.

The above enables manipulation of the magnetic characteristics of the primary and secondary magnetic circuits, including the respective armatures, to provide the desired operation of the valve or switch elements. This in turn influences movement of the respective armatures and provides a design parameter that can be selected to achieve the desired performance of the first and second valve or switch elements. In particular, the geometry and area relationship of the respective attracting surfaces of each armature (i.e.: the surfaces that come together with a corresponding attracting surface of the ferro-magnetic casing to close the respective gaps) is an important design parameter that may be engineered to achieve the desired operation of the first and second armatures.

The respective armatures may also be designed to be mechanically engaged. That is, the armatures may be designed such that one armature may cause by its movement, a desired movement of the second armature under mechanical influence. In this respect, the actuator allows movement of an armature by both mechanical and magnetic forces either throughout the total or a part of the extent of movement of either of the armatures.

Of course, any one or more of these parameters may be selected to obtain the desired operation of a solenoid actuated valve or switch apparatus. However, it will be understood that any of the parameters discussed above can be varied in combination to achieve the desired operation of the apparatus.

With the second object in view, the present invention provides a fuel injection apparatus comprising a solenoid coil; a first armature connected with a first valve element operable to open and close a fuel inlet valve to supply fuel to the fuel injection apparatus when the solenoid coil is selectively energised and de-energised, and a second armature connected with a second valve element operable to open and close a charge delivery valve to supply fuel from the injection apparatus when the same solenoid coil is selectively energised and de-energised.

The operation of the second armature may control a flow of gas to the injection apparatus wherein fuel is delivered entrained in a pressurised gas, typically air, to a combustion chamber of an engine. However, the present invention is not limited to usage in a solenoid actuated fuel injection apparatus in which such entrainment takes place.

In practice, the magnetic force generated by the solenoid coil will be acting predominantly against predetermined biasing forces, generated by springs or like means used to bias the armatures into a preferred position, generally according with a closed position of the valves. By exerting sufficient magnetic force on the appropriate armature, by appropriate control over the supply of current to the solenoid coil, the fuel inlet valve can be operated to allow a metered quantity of fuel into the fuel injection apparatus. This metered quantity of fuel can optionally be admixed with a pressurised gas such as air.

The electrical current to energise the solenoid coil may then preferably be increased at the required rate to open the second charge delivery valve to deliver the gas-fuel charge to a combustion chamber of an engine. Depending upon the configuration of the armatures of the fuel injection apparatus, and the design of the magnetic circuits for control thereof, the fuel inlet valve may remain open during all, or a portion, of the open time of the charge delivery valve or can in fact close as or before the charge delivery valve opens. In this respect, it will be understood that such overlapping operation of the charge delivery and fuel inlet valves is an inherent feature of the fuel injection apparatus described herein.

Such overlap of the operation of the charge delivery and fuel inlet valves may be relied upon, for example, to provide fuel fluxing control as described in the applicant's U.S. Pat. No. 4,800,862, the contents of which are hereby incorporated by reference. In such a case, the geometry and/or reluctance of the primary and secondary magnetic circuits relating to the first and second armatures influenced, for example, by the dimensions and geometry of the respective armature gaps, can also be varied by trial and error and/or calculation to achieve the desired overlapping operation of the valve elements.

It may typically be expected that the operation of the fuel inlet and/or charge delivery valves will require energisation of the solenoid coil in timed relation to the engine operating cycle to achieve the desired engine performance.

Further, it should be understood that the present invention is not limited in application to a specific fuel injector type. The present invention is therefore equally applicable to injectors in which fuel is delivered through a hollow stem connected to the charge delivery element (as in the manner disclosed in the applicant's U.S. Pat. No. 4,934,329, the contents of which are hereby incorporated by reference) and to injectors in which fuel or fuel/gas mixtures pass through or into an annular cavity surrounding the stem of the charge delivery valve element.

In the context of fuel injection apparatus, the actuator controlling the fuel metering and the fuel delivery (injection) as now proposed can have a number of advantages as follows:

(a) A separate solenoid operated fuel metering valve may be avoided through avoidance of a separate bulky fuel metering unit. Accordingly, the size of the combined fuel metering/injection unit may be reduced.

(b) By integration of the fuel metering and injection units, it can be possible to reduce the mass of moving components, particularly the armatures, with benefits in terms of lesser noise, vibration and harshness.

(c) The use of a single solenoid coil can reduce the overall power requirement of the fuel injection apparatus.

The present invention will be better understood from the following description of one embodiment thereof made with reference to the accompanying drawings in which.

Figure 1:
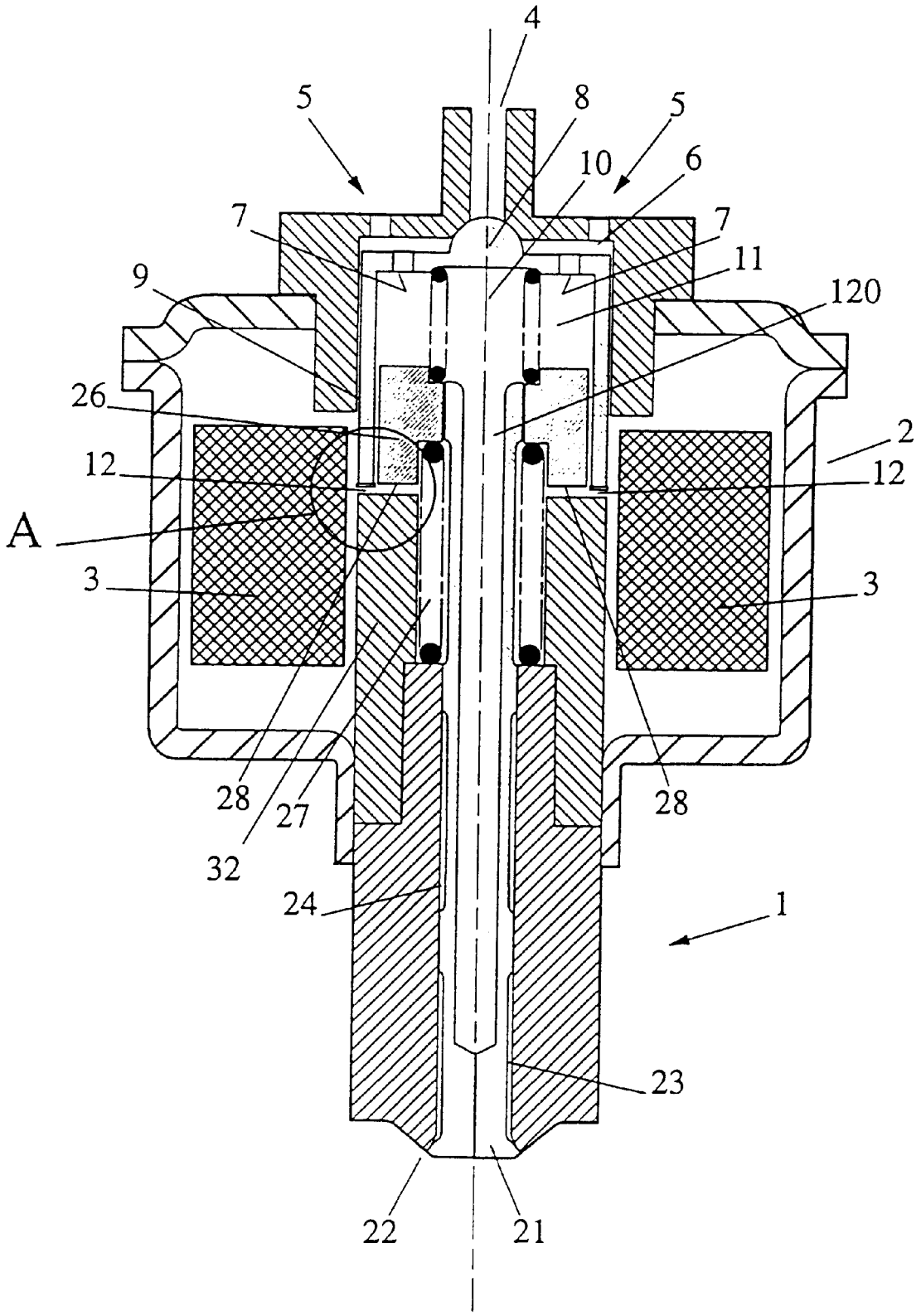
FIG. 1 is a sectional view of a fuel injection apparatus actuated by a solenoid operated valve actuator.

Referring now to FIG. 1, there is shown a fuel injector 1 having a ferro-magnetic housing 2 in which there is provided a single solenoid coil 3. A fuel inlet 4 connectable to a supply of pressurised fuel, and a gas inlet 5 connectable to a supply of pressurised gas, are also provided in the housing 2. Ordinarily, the pressurised gas will be employed to propel quantities of fuel, entering the fuel injector 1 through fuel inlet 4, into the combustion chamber (not shown) of an internal combustion engine. Conveniently, in such a case, the gas is air and the source of pressurised air is an air compressor (not shown) driven in dependence on the operation of the engine.

In injector 1, fuel and air are admixed in chamber 6 and enter through bores 7 into a fuel chamber 10 to travel through passage 20, formed in a stem 24 extending from a valve element 21 which is selectively operable to open and close the charge delivery port 22. For this purpose, apertures are formed in the region 23 of the stem 24.

The fuel inlet 4 is itself selectively operable to bring the injector 1 into communication with the fuel supplied through fuel inlet valve 8, which is opened and closed in timed relation to a cycle of the engine. To this end, fuel inlet valve 8 is rigidly connected to a fuel inlet armature 9 and is biased into a closed position, by a spring 11 of appropriately selected physical characteristic, whereby the fuel inlet armature 9 is axially spaced from the inner wall 126 of the solenoid to define an axial air gap or magnetic circuit gap at 12.

Similarly, the charge delivery valve stem 24 is rigidly connected to a charge delivery armature 26 and is also biased into a closed position by a spring 27 of appropriately selected physical characteristic. The charge delivery armature 26 thereby define the axial air gap or magnetic circuit gap 28 between the armature 26 and the inner wall 126 of the solenoid.

Figure 2:
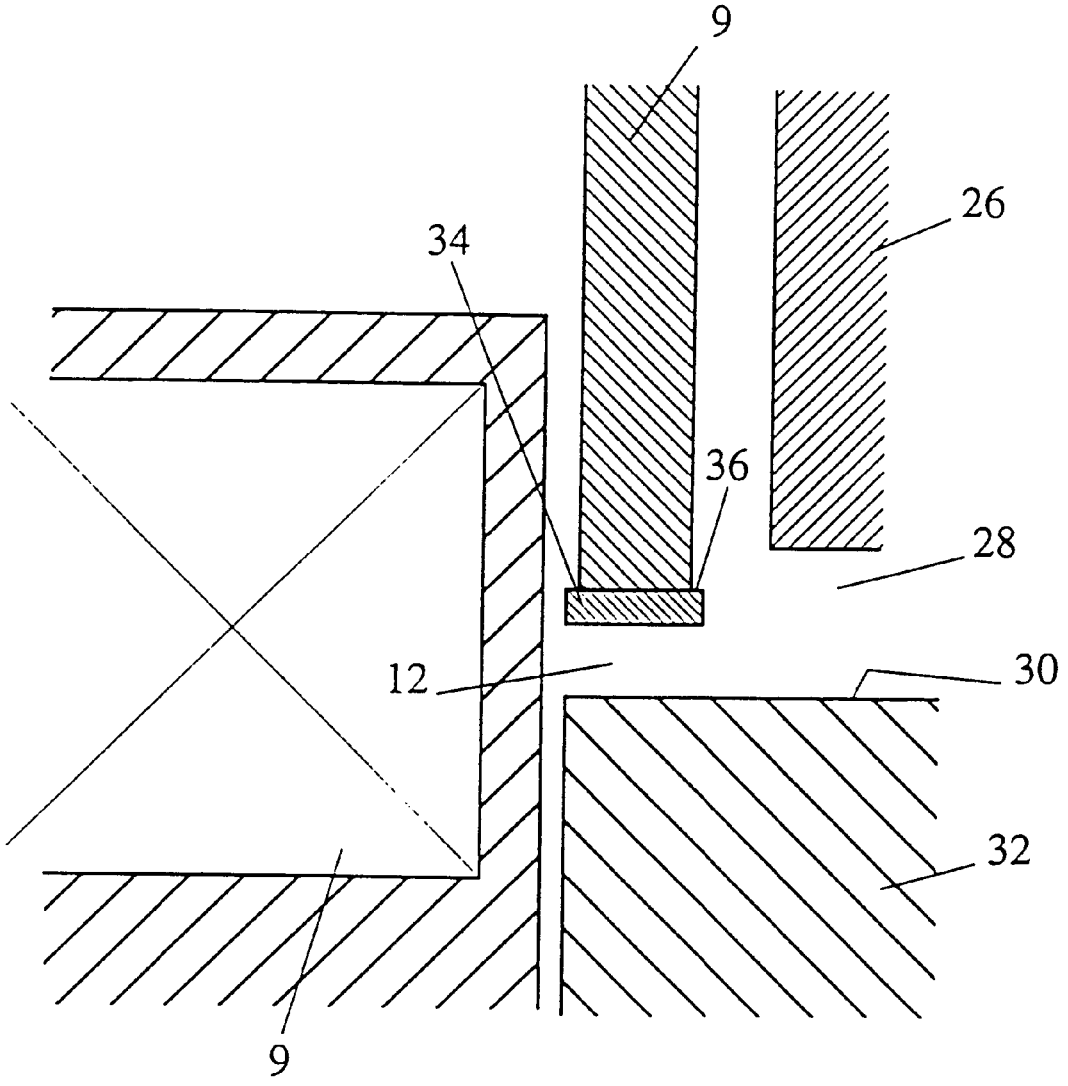
FIG. 2 is a magnified view of region A of FIG. 1, showing in more detail the construction of that region.

Turning now to FIG. 2, pole face 30 of internal housing member 32 is shown adjacent armatures 9, 26. A low magnetic permeability spacer 34 is positioned between armature 9 and pole face 30. Due to the low permeability of the spacer 34, the effective magnetic gap 12 is still measured between the lower face 36 of the armature 9 and the pole face 30. Although the spacer 36 does not affect the magnetic gap 12, it provides a physical barrier preventing the armature 9 from moving within a physical distance of the pole face 30 by at least the axial dimension of the spacer 35. This sets the minimum value of the magnetic gap 12. In contrast, the armature 26 is able to approach the pole face 30 and the minimum dimension for the magnetic gap 28 is effectively zero. The respective minimum magnetic gap for each armature 9, 26 occurs when the armature 9, 26 is in the fully actuated state.

The maximum dimension for the magnetic gaps 12, 28 is set by end stops in the form of engagement of the valves 8, 21 with their respective seating surfaces. Thus the magnetic gaps 12, 28 vary from minimum (associated with valves 8, 21 respectively being in the open condition) to maximum (associated with valve 8, 21 respectively being in the closed condition).

The maximum dimension of the magnetic gap 28 of the air charge delivery armature 26 is selected to have a greater axial dimension than the maximum magnetic gap 12 of the fuel inlet armature 9.

The armature 9 forms part o the primary magnetic circuit and the armature 26 forms part of the secondary magnetic circuit.

Movement of charge delivery armature 26 must be caused by a magnetic force equal to or greater than the biasing spring force imposed by spring 27. Similarly, the movement of fuel inlet armature 9 must be caused by a magnetic force equal to or greater than the biasing spring force imposed by spring 11. In this embodiment, spring 27 imposes a slightly greater biasing force on armature 26 than spring 11 imposes on armature 9.

As a result of the differential between forces imposed by the respective springs 11, 27 and between maximum magnetic gaps of the respective armatures 9, 26, when the solenoid 3 is energised to a predetermined level of current, there will be a tendency for the fuel inlet valve 8 to open, with the charge delivery valve element 21 opening only on further increases in the level of current. This is desirable to achieve a desired fuel fluxing and emissions performance as described in the applicant's U.S. Pat. No. 4,800,862, the contents of which are hereby incorporated by reference.

The operation of fuel injector 1 will now be described, with appropriate reference to FIGS. 1 and 2 as follows.

Energisation of solenoid coil 3 by increasing the current supplied thereto causes a rise of the attracting magnetic force acting on both armatures 9 and 26. As is known to those skilled in the art, an attracting force exists across each respective gap 12 and 28 and serves to ultimately attract each respective armature 9 and 26 towards pole face 30 which, together with a portion of the ferro-magnetic housing 2 and internal housing 32, serves to complete a respective magnetic flux path, which includes the respective armatures 9 and 26. The spring pre-load of spring 11 is set such that shortly before magnetic saturation of the armature gap 12 occurs, the magnetic force acting on the fuel inlet armature 9 is sufficient to overcome the spring force imposed by spring 11 and gap 12 commences to approach its minimum dimension.

As discussed above, the primary magnetic circuit is designed such that when the armature gap 12 is at its minimum value, "zero" reluctance between the respective surfaces is avoided. At this point, the attracting magnetic force acting on the charge delivery armature 26 is still not sufficient to overcome the spring pre-load imposed by spring 27, hence charge delivery port 22 remains closed. This first step equates to the opening of a separate fuel metering nozzle in a prior art two fluid fuel injection system to enable fuel to flow into a holding chamber of a charge delivery injector. In the present case, fuel is enabled to enter the fuel chamber 10 via the fuel inlet 4.

Further increase in the current energising solenoid coil 3 causes no appreciable increase in the holding force acting on fuel inlet armature 9 as the circuit is effectively saturated, but the magnetic force acting on the charge delivery armature 26 continues to rise. At this point, the secondary magnetic circuit becomes fully saturated. Since the force induced by the energising current, is sufficient to overcome the set biasing pre-load of the spring 27, the charge delivery armature 26 commences to close the gap 28. The reduction in size of the armature gap 28 does not cause further appreciable increase of the magnetic flux as the secondary magnetic circuit is saturated. Hence, the magnetic forces acting on both armatures 9 and 28 remain effectively unchanged, but both valves are open and hence there is an overlap between the opening of the charge delivery port 22 and of the fuel inlet valve 8.

As both magnetic gaps 12, 28 are at their minimum, the reluctance of both primary and secondary magnetic circuits is decreased, and a decrease in current is possible without affecting the opened condition of the valves 8 and 21. This is accordingly implemented to reduce the current in the solenoid which reduces the power consumption of the system. This "holding current", as it is commonly known, whilst being less than the currents necessary to open the valves 8 and 21, is sufficient to maintain the valves 8 and 21 in the opened positions.

In respect of a prior art two fluid injection system, the next step relates to a separate fuel metering injector continuing to meter fuel to a charge delivery injector while the charge delivery injector is injecting the existing fuel air mixture into the combustion chamber of an engine. In the present case, fuel entrained in air has commenced being delivered or injected directly into the combustion chamber of the engine whilst a certain amount of fuel is still being metered into the fuel chamber 10 via the fuel inlet 4. Hence, depending on the opening relationship of the fuel inlet valve 8 and the charge delivery valve element 21, a desired degree of fuel fluxing may be achieved as previously described with reference to injector systems wherein individual solenoids are used to control fuel metering and fuel delivery.

Further reduction of the current in the example now described to a predetermined level reduces the magnetic flux in the magnetic circuit to a point where it is no longer sufficient to overcome the biasing spring pre-load of the spring 11. At this point, the armature gap 12 will begin to open and hence the fuel inlet valve 8 commences to close. The increased reluctance of the primary circuit caused by the inclusion of the low permeability spacer 36 (providing a non-zero minimum magnetic gap 12) encourages the opening of the magnetic gap 12 prior to the magnetic armature 26. This is because magnetic flux of the solenoid coil 3 will tend to flow through the second magnetic circuit due to lower reluctance, thus providing energy to hold the air charge armature 26 in contact with the pole face 30.

If the solenoid current is held steady, the charge delivery valve element 21 may be maintained open whilst the fuel inlet valve 8 is closed. This third step equates to the fuel metering injector of a prior art two injector, two solenoid system being closed and the charge delivery injector thereof being open to deliver some or all of the remaining metered quantity of fuel. Further, this may also equate to the situation where all of the metered quantity of fuel has been delivered and due to certain desired operating strategies, it is necessary to maintain the charge delivery injector open. For example, this may be desirable for certain periods of engine operation to allow a clean routine strategy as described in the applicant's U.S. Pat. No. 5,195,482 which is incorporated herein by reference.

Finally, switching off or reducing the current energising the solenoid coil 3 to zero will cause the armature gap 28 to open and hence close the charge delivery port 22.

Figure 3:
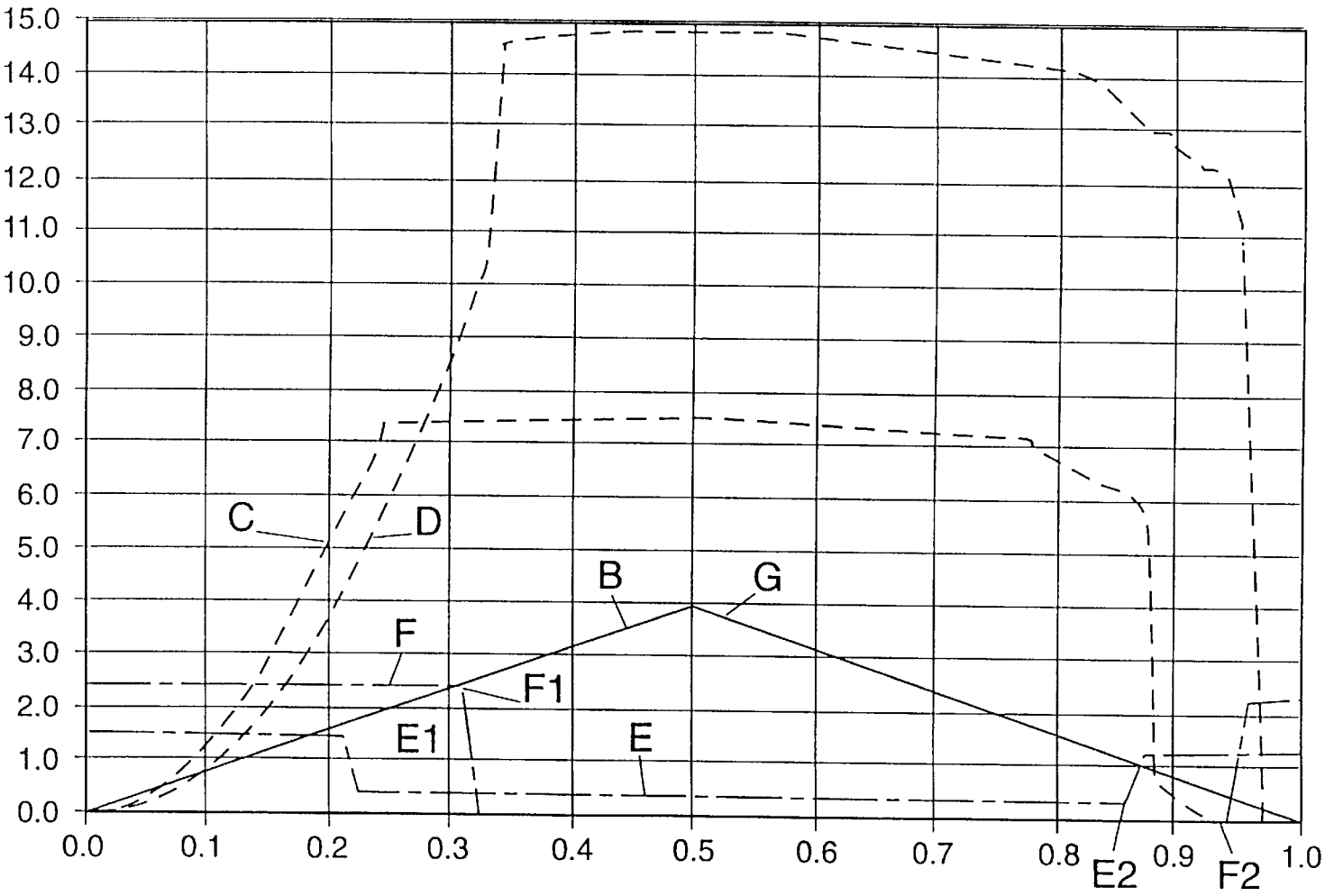
FIG. 3 is a series of plots illustrating the performance of the injector as the current applied to the solenoid rises and falls during one cycle.

Referring now to FIG. 3 of the drawings which consist of a graph wherein there is plotted the gap between the respective armatures and the solenoid as the current in the solenoid rises and falls through one cycle. In addition, there is also plotted the force applied to the armature as the current in the solenoid passes through its cycle.

Plot B is the current variation in the solenoid as it rises at a steady rate from zero to a maximum and then decays at a steady rate to zero again. As the current in the solenoid increases, the magnetic force applied to the respective armatures 9 and 26 increases. However, due to the construction of the device, and in particular as the gap between the pole face 30 and armature 9 is less than that between the pole face 30 and armature 26, the magnetic force applied to armature 9 as indicated by Plot C rises more rapidly than that applied to armature 26 as indicated in Plot D.

As a result of this more rapid rise in the magnetic force C, the armature 9 will be the first to commence to move in the direction towards the solenoid, this movement commencing at point E1 in Plot E of the position of armature 9. Shortly after the armature 9 has travelled the full extent possible, as defined by the contact thereof with abutment points in the fuel injector 1, the armature 9 becomes saturated, the force applied to the armature 9 will remain substantially constant although the current continues to rise. At this condition the valve B has moved to the fully open position.

Considering now the operation of armature 26, it will be noted that movement thereof does not commence until a significant period after the application of the current to the solenoid and after the armature 9 has reached its full extent of movement. The point of commencement of movement of the armature 26 is indicated at F1 in Plot F of the position of the armature 26. It is thus seen that the armature 9 will move to its full extent as indicated by Plot E, a considerable time before the armature 26 has reached its full open position as represented by Plot F.

Upon the current commencing to reduce as indicated at G, the magnetic force applied by the solenoid to the respective armatures 9 and 26 will commence to decay, but the armature 9 leaves its magnetically saturated condition prior to armature 26 doing so, and once the armature 9 is no longer magnetically saturated further reduction in current leads to a more rapid decrease in the magnetic force applied to the armature 9, and hence the armature 9 will commence to move away from the solenoid under the action of the spring 11 as indicated at E2 earlier than when the armature 26 commences to move away from the solenoid as indicated at F2. Hence the valve 8 connected to the armature 9 will close prior to the valve 21 connected to the armature 26.

It is thus seen that the relative timing of the opening and closing of the valves can be controlled and adjusted by appropriate control of current flowing in the solenoid and the rate and timing of the change of that current.

Referring now to FIG. 3 of the drawings which consist of a graph wherein there is plotted the gap between the respective armatures and the solenoid as the current in the solenoid rises and falls through one cycle. In addition, there is also plotted the force applied to the armature as the current in the solenoid passes through its cycle.

Plot B is the current variation in the solenoid as it rises at a steady rate from zero to a maximum and then decays at a steady rate to zero again. As the current in the solenoid increases, the magnetic force applied to the respective armatures 9 and 26 increases. However, due to the construction of the device, and in particular as the gap between the pole face 30 and armature 9 is less than that between the pole face 30 and armature 26, the magnetic force applied to armature 9 as indicated by Plot C rises more rapidly than that applied to armature 26 as indicated in Plot D.

As a result of this more rapid rise in the magnetic force C, the armature 9 will be the first to commence to move in the direction towards the solenoid, this movement commencing at point E1 in Plot E of the position of armature 9. Shortly after the armature 9 has travelled the full extent possible, as defined by the contact thereof with abutment points in the fuel injector 1, the armature 9 becomes saturated, the force applied to the armature 9 will remain substantially constant although the current continues to rise. At this condition the valve B has moved to the fully open position.

Considering now the operation of armature 26, it will be noted that movement thereof does not commence until a significant period after the application of the current to the solenoid and after the armature 9 has reached its full extent of movement.

The point of commencement of movement of the armature 26 is indicated at F1 in Plot F of the position of the armature 26. It is thus seen that the armature 9 will move to its full extent as indicated by Plot E, a considerable time before the armature 26 has reached its full open position as represented by Plot F.

Upon the current commencing to reduce as indicated at G, the magnetic force applied by the solenoid to the respective armatures 9 and 26 will commence to decay, but the armature 9 leaves its magnetically saturated condition prior to armature 26 doing so, and once the armature 9 is no longer magnetically saturated further reduction in current leads to a more rapid decrease in the magnetic force applied to the armature 9, and hence the armature 9 will commence to move away from the solenoid under the action of the spring 11 as indicated at E2 earlier than when the armature 26 commences to move away from the solenoid as indicated at F2. Hence the valve 8 connected to the armature 9 will close prior to the valve 21 connected to the armature 26.

It is thus seen that the relative timing of the opening and closing of the valves can be controlled and adjusted by appropriate control of current flowing in the solenoid and the rate and timing of the change of that current.

Of course, the above described sequence of events is ideally to be carefully controlled in relation to the point in an engine cycle where the respective valves 8 and 21 are required to be opened or closed. Thus, the timing of changes in current is advantageously set by an electronic control unit (ECU) which controls total operation of the fuel injector 1. Such appropriate timings are the subject of discussion in the applicant's U.S. Pat. No. 4,800,862 and references may be made to that disclosure.

It is to be understood that the actuator as disclosed herein is not to be limited in its application to a fuel injector as above described. It may be well understood that the actuator is equally applicable to other types of fluid injectors without departing from the present invention.

Further, it is to be understood that whilst the present embodiment has been described with respect to a magnetic circuit comprising high reluctance elements such as air gaps in a parallel configuration, other configurations of such elements, such as serial configurations, may be envisaged.

The primary or fuel inlet armature 9 and secondary or charge delivery armature 26 may be mechanically engaged in some manner. Referring to the above description it will be noted that closure of the fuel inlet armature gap 12 did not cause any mechanical influence over the armature 26. However, the system may be designed by use of suitable mechanical linkage, arrangement of biasing springs or arrangement of the armatures 9 and 26 such that the opening of the armature gap 12 tends to cause the opening of armature gap 28 or such that the opening of armature gap 28 tends to cause the closing of armature gap 12. It may be well appreciated that the reluctance of both gaps may also be chosen, perhaps in conjunction with selection of spring pre-load forces, to achieve a similar result.

For specific operations or purposes, it may be desirable to prevent the armature 9 from being actuated. In this regard, physical means may be provided to axially rotate the armature 9 into a position which would prevent movement thereby. Accordingly, it would then be possible to actuate only the armature 26 to open the charge delivery port 22. This may be desirable to enable the use of various control strategies during certain periods of engine operation. Such control strategies may include the clean routine strategy as described hereinbefore and a gas volume pump-up strategy as disclosed in the applicant's U.S. Pat. No. 4,936,279 which is hereby incorporated by reference.

It will be understood that the actuator disclosed herein is not limited to fuel injection applications and may be applied in other fields without departing from the scope of the present invention.

We claim:

1. A fuel injection apparatus comprising a single solenoid coil, a first armature connected with a first valve element operable to open and close a fuel inlet valve to supply fuel to a fuel injection chamber when the solenoid coil is selectively energized and de-energized, and a second armature connected with a second valve element operable to open and close a charge delivery valve to supply fuel from the injection chamber when the same solenoid coil is selectively energized and de-energized, wherein said first valve element and said second valve element can be opened and closed in the same order as the single solenoid coil is energized and de-energized.

2. A fuel injection apparatus as claimed in claim 1, wherein said apparatus is operable to open or close the first valve element prior to the opening and closing respectively of said second valve element.

3. A fuel injection apparatus claimed in claim 1 or 2 wherein said second armature controls air charge flow in the apparatus in which fuel is entrained in an air charge to delivery to an internal combustion engine.

4. A fuel injection apparatus comprising:

a single solenoid coil;

a first armature connected with a first valve element operable to open and close a fuel inlet valve to supply fuel to a fuel injection chamber, and a second armature connected with a second valve element operable to open and close a charge delivery valve to supply fuel from the injection chamber, the first armature being movable between first and second configurations in response to selective energization of the solenoid coil, the second armature being movable between first and second configurations in response to selective energization of the solenoid coil, said first configuration of each armature corresponding to a closed configuration of the respective valve and said second configuration of each armature corresponding to an open configuration of the respective valve; wherein (i) energization of the solenoid coil first causes said first armature to move from its first configuration to its second configuration, (ii) further energization of the solenoid coil causes said second armature to move from its first configuration to its second configuration, and (iii) when both armatures are in their respective second configurations, reduction in energization level of the solenoid coil to a first predetermined level will result in the return of the first armature to its first configuration, and subsequent reduction in the energization level of the solenoid coil to a second predetermined energization level lower than said first predetermined energization level, will result in the return of the second armature to its first configuration.

5. A fuel injection apparatus as claimed in claim 4, wherein said first configuration of each respective armature corresponds to an at rest configuration of each said armature, and said second configuration of each respective armature corresponds to an actuated configuration of said armature.

6. A fuel injection apparatus as claimed in claim 4, wherein the movement of the first and second armatures are respectively controlled by a magnetic armature gap provided between each said armature and a pole face of the apparatus.

7. A fuel injection apparatus according to claim 6, wherein a physical abutment is provided to control the magnitude of the magnetic armature gap in relation to the respective armature.

8. A fuel injection apparatus according to claim 7, wherein the physical abutment is a spacer of low magnetic permeability positioned between a pole face of the solenoid operated actuator and an opposing surface of said respective armature.

9. A fuel injection apparatus according to claim 6, wherein the movement of the first and second armatures are further controlled by a bias means providing a bias against at least one of the armatures when the solenoid coil actuates the respective armature.

10. A fuel injection apparatus according to claim 9, wherein the bias means is a spring acting against the force produced by the energization of the solenoid coil.

11. A fuel injection apparatus comprising:

a single solenoid coil;

a first armature connected with a first valve element operable to open and close a fuel inlet valve to supply fuel to a fuel injection chamber, and a second armature connected with a second valve element operable to open and close a charge delivery valve to supply fuel from the injection chamber, the first armature being movable between first and second configurations in response to selective energization of the solenoid coil, the first armature being biased towards said first configuration by a first biasing element, the second armature being movable between first and second configurations in response to selective energization of the solenoid coil, the second armature being biased towards said first configuration by a second biasing element, said first configuration of each armature corresponding to a closed configuration of the respective valve and said second configuration of each armature corresponding to an open configuration of the respective valve, the first armature being actuated towards its second configuration at a first predetermined solenoid energization level, the second armature being actuated towards its second configuration at a second predetermined solenoid energization level, higher than said first solenoid energization level;

wherein when both first and second armatures are in their respective second configurations, at a given solenoid energization level, the magnetic force above the biasing force in the second armature is stronger than the magnetic force above the biasing force in the first armature, such that the first armature returns to its first configuration at a solenoid energization level higher than the solenoid energization level at which the second armature returns to its first configuration.

12. A fuel injection apparatus claimed in claim 11, wherein said second armature controls air charge flow in the apparatus in which fuel is entrained in an air charge to deliver to an internal combustion engine.

13. A method of operating a fuel injection apparatus comprising a single solenoid coil, a first armature connected with a first valve element operable to open and close a fuel inlet valve to supply fuel to the fuel injection apparatus, and a second armature connected with a second armature connected with a second valve element operable to open and close a charge delivery valve to supply fuel from the fuel injection apparatus, the first armature being movable between first and second configurations in response to selective energization of the solenoid coil, said first configuration of each armature corresponding to a closed configuration of the respective valve and said second configuration of each armature corresponding to an open configuration of the respective valve; the method comprising (i) energizing the solenoid coil to a first energization level to cause said first armature to move from its first configuration to its second configuration, (ii) further energizing of the solenoid coil to a second energization level higher than the first energization level to cause said second armature to move from its first configuration to its second configuration, and (iii) when both armatures are in their respective second configurations, reducing the energization level of the solenoid coil to a first predetermined energization level to thereby return the first armature to its first configuration, and subsequently further reducing the energization level of the solenoid coil to the second predetermined energization level to thereby return the second armature to its first configuration.

14. A method of operating a fuel injection apparatus comprising a single solenoid coil, a first armature connected with a first valve element operable to open and close a fuel inlet valve to supply fuel to the fuel injection apparatus, and a second armature connected with a second valve element operable to open and close a charge delivery valve to supply fuel from the fuel injection apparatus, the first armature being movable in response to selective energization of the solenoid coil, the second armature being movable in response to the said selective energization of the solenoid coil; the method comprising energizing the solenoid coil from zero to a predetermined level and subsequently returned to zero such that the movement of the first and second armatures provide the following valve sequence:

(i) both fuel inlet valve and charge delivery valve are closed (ii) fuel inlet valve opens, charge delivery valve remains closed (iii) fuel inlet valve remains open, charge delivery valve opens (iv) fuel inlet valve remains closed, charge delivery valve closes.

* * * * *